United States Patent [19]

Thévenon

[11] Patent Number: 4,584,432

[45] Date of Patent: Apr. 22, 1986

[54] SUBMARINE POWER CABLE CONDUCTOR

[75] Inventor: Henri Thévenon, Lyons, France

[73] Assignee: Les Cables de Lyon, Cedex, France

[21] Appl. No.: 629,293

[22] Filed: Jul. 9, 1984

[30] Foreign Application Priority Data

Jul. 11, 1983 [FR] France ..... 83 11523

[51] Int. Cl.[4] ..... H01B 5/08

[52] U.S. Cl. ..... 174/128 R; 57/204; 57/214; 174/130

[58] Field of Search ..... 174/128 R, 130; 57/204, 57/212, 213, 214, 218

[56] References Cited

U.S. PATENT DOCUMENTS

| | | | |
|---|---|---|---|
| 1,626,776 | 5/1927 | Austin | 174/128 R |
| 1,919,509 | 7/1933 | Grobl | 174/128 R |
| 1,982,784 | 12/1934 | Buckley | 174/108 |
| 2,128,410 | 8/1938 | Hall | 174/113 R |
| 2,163,235 | 6/1939 | Chatham | 174/107 |
| 2,197,544 | 4/1940 | Atkinson | 174/130 X |
| 2,203,232 | 4/1940 | Osborne et al. | 174/107 |
| 3,061,997 | 11/1962 | Haugwitz | 174/128 R |
| 3,187,495 | 6/1965 | Christian, Jr. | 57/204 X |
| 4,333,306 | 6/1982 | Yamashita et al. | 57/213 X |
| 4,446,689 | 5/1984 | Hardin et al. | 57/204 |

FOREIGN PATENT DOCUMENTS

| | | | |
|---|---|---|---|
| 2528970 | 1/1977 | Fed. Rep. of Germany | 174/108 |
| 1170046 | 1/1959 | France . | |
| 1509988 | 1/1968 | France . | |
| 2380370 | 9/1978 | France . | |
| 1010169 | 4/1983 | U.S.S.R. | 57/213 |

*Primary Examiner*—A. T. Grimley
*Assistant Examiner*—Morris H. Nimmo
*Attorney, Agent, or Firm*—Sughrue, Mion, Zinn Macpeak & Seas

[57] ABSTRACT

A submarine power cable conductor consisting of at least one layer of stranded metal wires, all of said wires being laid in the same direction and at a periodically varied angle.

2 Claims, 6 Drawing Figures

SUBMARINE POWER CABLE CONDUCTOR

This invention concerns a conductor for submarine or undersea power cable, as well as a method of manufacturing such a conductor.

A submarine power cable basically consists of one to three conductors stranded at a constant pitch and insulated, said assembly being surrounded by an armor of helically wound steel wires. The purpose of the armor is to protect the insulation layers and to increase the cable's tensile strength.

During laying of the cable, the cable is subjected to a tensile force F induced by its own weight. As a result, the cable becomes elongated, generally by less than 1%, and a force $F_1$ is induced in the conductor and a force $F_2$ in the armoring, where $F=F_1+F_2$. However, due to the high tensile modulus of a constant pitch stranded cable, $F_1$ is often greater than $F_2$ and the armoring does not entirely fulfill its carrying function—an espcially important consideration for deep-layed cables.

It is the object of this invention to provide a lower tensile modulus than that inherent in a constant pitch helical stranding to reduce the force $F_1$ imposed on the conductor.

The invention provides a submarine power cable conductor consisting of at least one layer of stranded metal wires, wherein all the wires are laid in the same direction and at a periodically varied angle. Accordingly, all the wires twist about a mean winding helix, such that when the conductor is stretched, each wire in the conductor will follow the elongation thereof through a modification of its geometrical position bringing it closer to said means winding helix without any elongation of the wire itself.

Preferably, the pitch of the undulation generated by the periodically varied angle is less than twice the mean stranding pitch.

Another object of the invention is to provide a fabrication method whereby the lay angle is periodically varied.

According to a first mode of implementing this method, the periodic variation of the lay angle is obtained by varying the rotational speed of the stranding block through which the wires pass.

According to a second mode of implementing said method, the periodic variation of the lay angle is obtained by varying the speed of the capstan receiving said wires.

Other features and advantages of the invention will become apparent from the following description of embodiments mentioned for purposes of illustration but in no way limiting the scope of the invention, with reference to the appended drawings in which.

Figure 1:
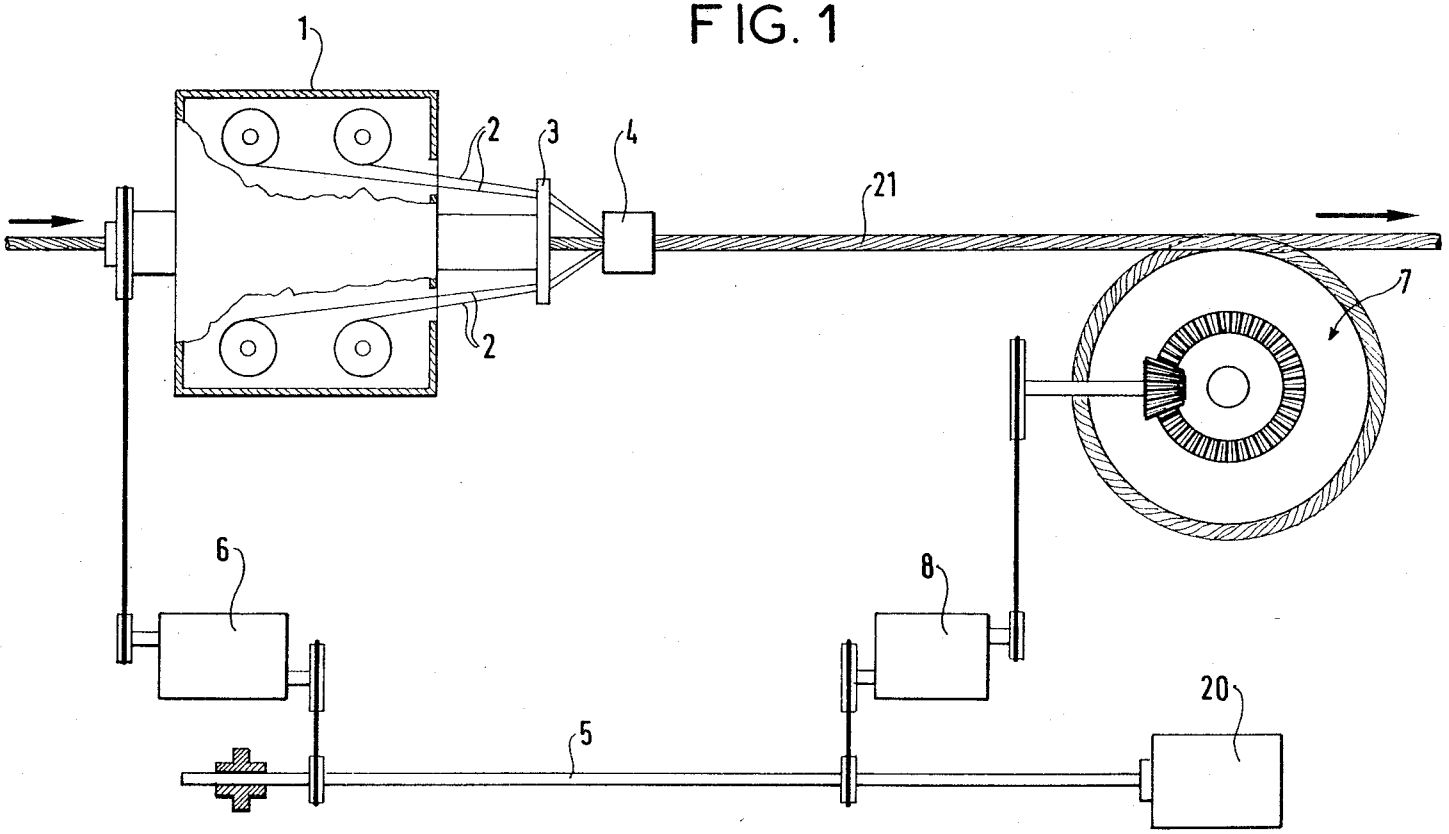
FIG. 1 is a highly simplified schematic drawing of the main parts of a stranding machine.

As shown in FIG. 1, a stranding machine consists of the following basic parts: one or more cages 1 each supporting several spools of wire 2; a distribution block 3 attached to said cage 1, through which the several wires pass; a stranding die 4 into which the wires converge and whereby they are made into a conductor 21; and a motor 20 rotatably driving a main shaft 5.

The box 1 is rotatively driven by the main shaft 5 via a transmission linkage comprising a gearbox 6. A winch capstan 7 is similarly driven by the main shaft via a gearbox 8.

If $\omega$ is the instantaneous rotational speed of the cage and its distribution block and v the instantaneous drawing speed of the capstan, for a conductor winding radius r, the lay angle is:

$$\tan\alpha=\omega r/v$$

There are two ways to vary said lay angle:

(a) by varying the rotational speed $\epsilon$ of the distribution block, or (b) varying the drawing speed v (which in fact means varying the rotational speed $\omega'$ of the capstan).

Figure 2:
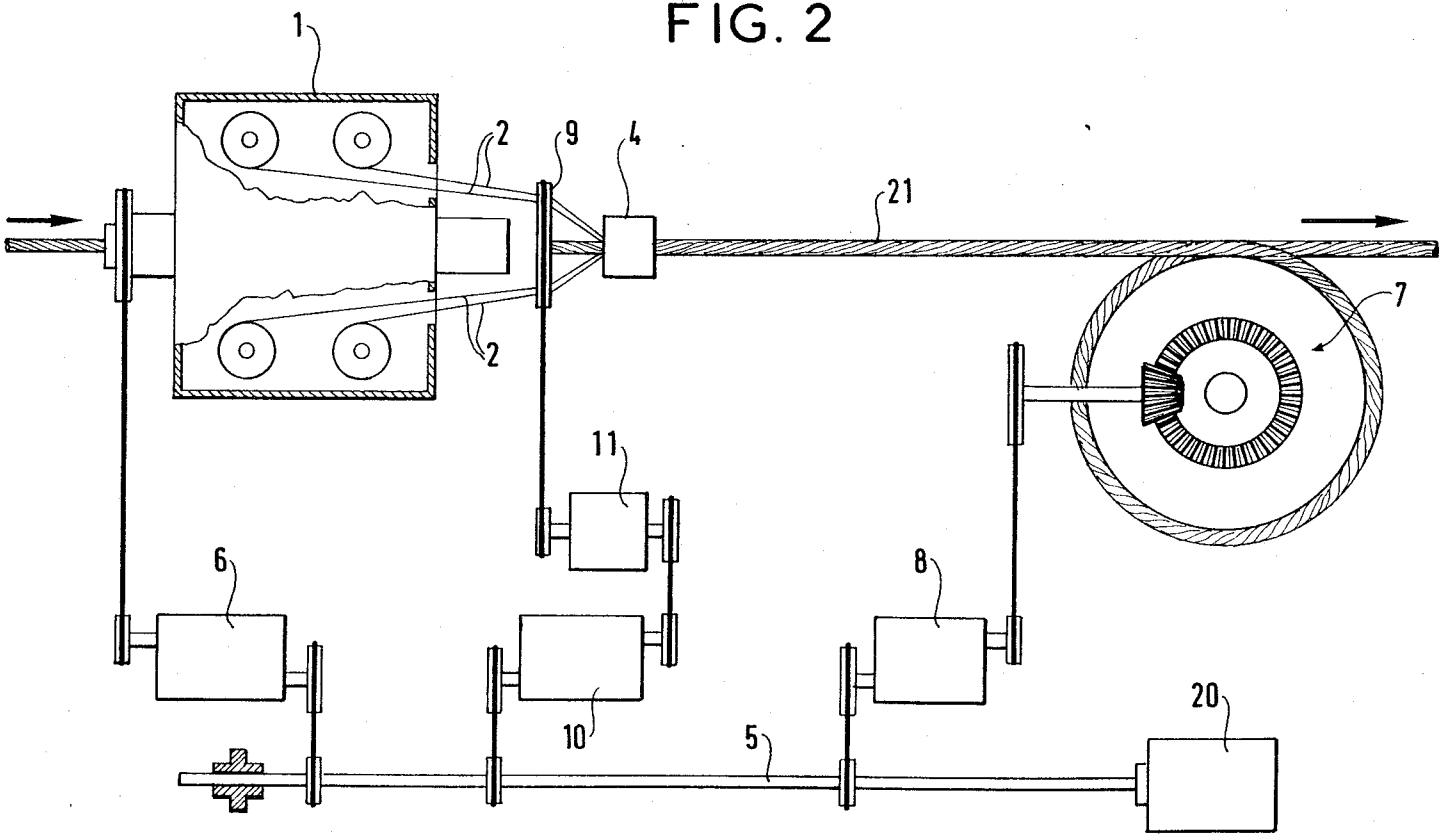
FIG. 2 shows a first variant of the machine in FIG. 1 enabling the working of the method according to the invention.

FIG. 2 shows the stranding machine equipped with a device for varying the speed $\omega$ of the distribution block. Instead of the block 3 of FIG. 1, a distribution block 9 is installed, driven independently of the cage by means of a transmission linkage which includes a gearbox 10 having the same gear ratios as the cage gearbox 6. The linkage is further provided with a variable-speed drive 11.

Figure 3:
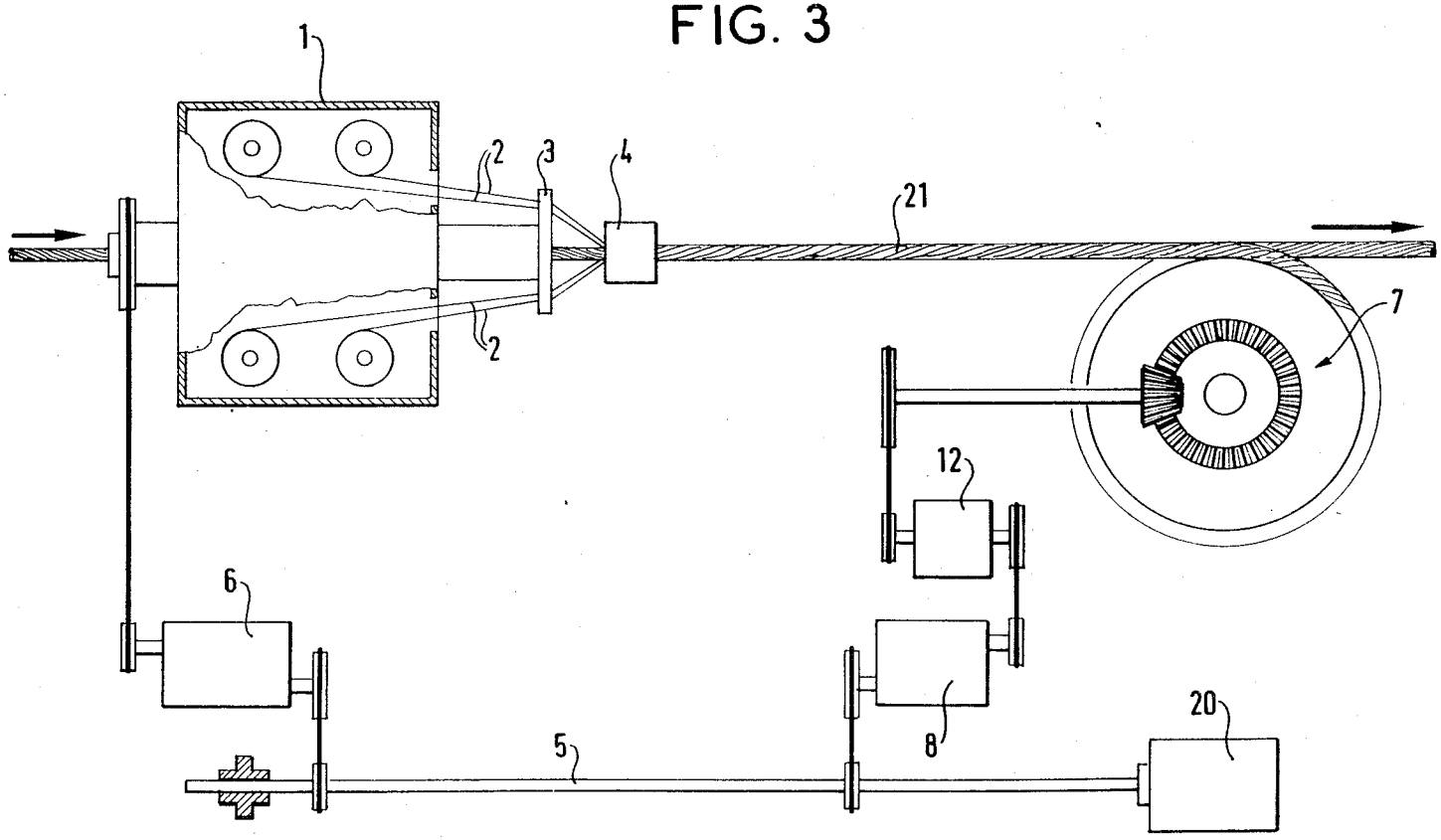
FIG. 3 shows a second variant of the machine in FIG. 1 enabling the working of the method according to the invention.

FIG. 3 shows the stranding machine equipped with a device for varying the drawing speed v of the capstan 7. The capstan linkage is further provided with a variable-speed drive 11.

Various known mechanical or electrical devices can be used to obtain a periodically variable rotational speed. For example any of the following four mechanical-type devices can be used:

(1) A two-speed planetary gearbox. The speed can be changed merely by braking the planetary gears to obtain $\omega\simeq\omega_1$ or $\omega\simeq\omega_2$.

(2) One or more universal joints. The output speed of such a joint varies with the angle $\theta$ of the joint according to the relation $\omega=\omega_o\ (1+\theta^2\ \sin\ ^2\omega_o t)$ when $\theta$ is small.

(3) Non-constant ratio gears. These are noncircular gears such as, for example, elliptical gears. Their mean ratio is generally equal to one.

(4) A differential, enabling an oscillating motion produced otherwise to be superimposed upon the uniform rotation of the drive shaft.

All of the means just mentioned make it possible to obtain a conductor the wires whereof are stranded according to a periodically variable lay angle.

Figure 4:
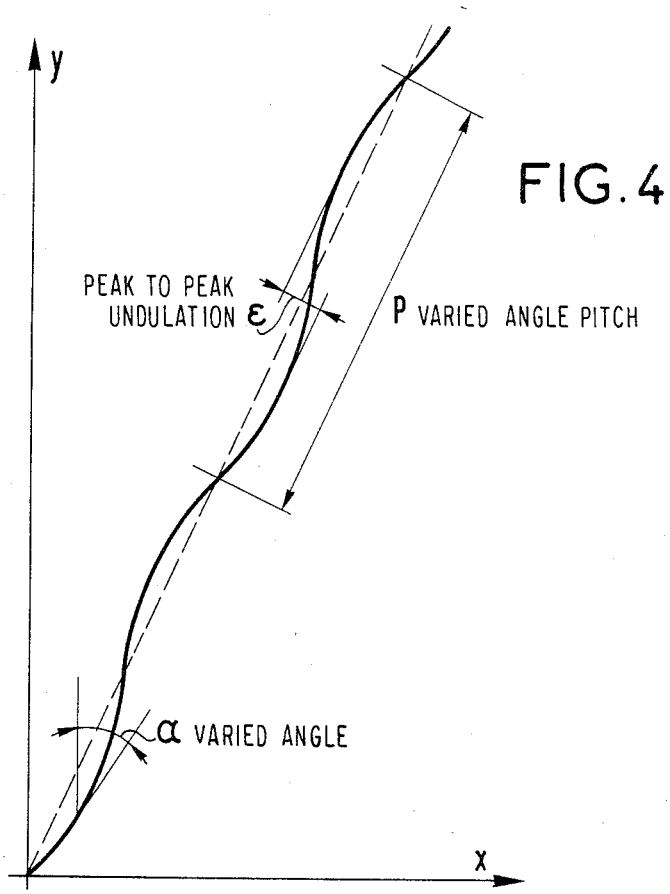
FIG. 4 is the evolute of a wire included in a stranded conductor made by the method of the invention.
Figure 4B:
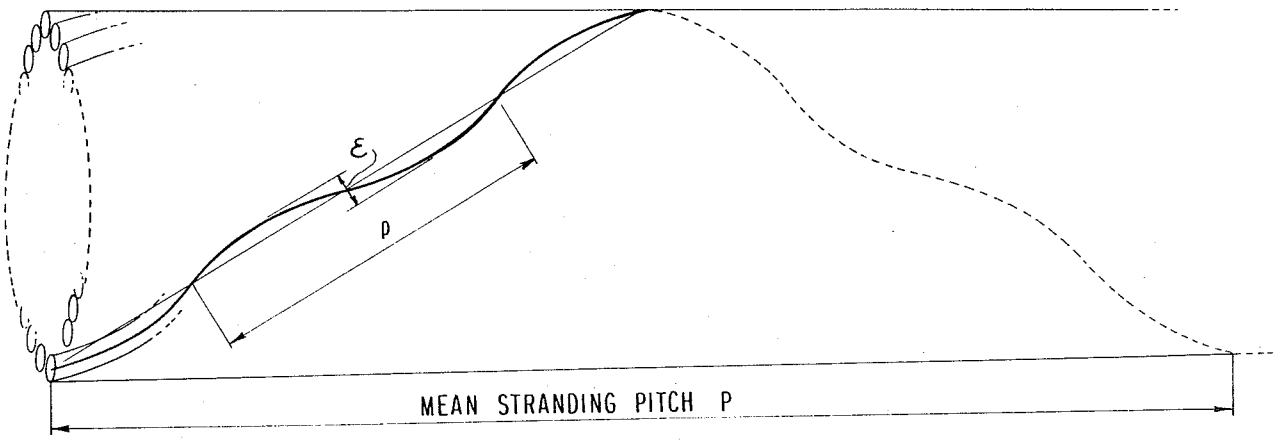
FIG. 4B is a diagrammatic perspective view corresponding to FIG. 4, with the central conductor metal wires laid in the same direction and at a periodic varied angle and illustrating the mean stranding pitch (P), the varied angle pitch (p) and the amplitude of the peak-to-peak undulation ($\epsilon$).

The evolute of such a conductor wire laid according to a variable lay angle $\alpha$ is shown in FIGS. 4, and 4B in a coordinate system $(\vec{Ox},\vec{Oy})$.

The wire undulation pitch is p and the peak-to-peak amplitude of its undulation is $\epsilon$. The value of p is preferably less than twice the means stranding pitch. The value of $\epsilon/p$ is selected to be between 3% and 7%, which corresponds to a geometrical elongation of the wires in the 0.2% to 1% range.

Figure 5:
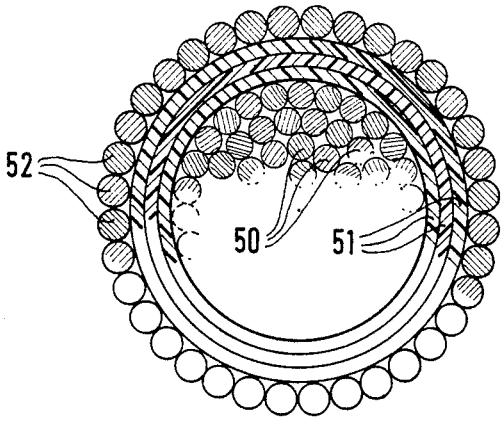
FIG. 5 is a diagram of the cross section of a submarine power cable comprising a conductor according to the invention.

FIG. 5 shows a submarine power cable comprising a single conductor consisting of wires 50 according to the invention. Said conductor is wrapped in several layers of insulation 51 which may be oil-impregnated paper, or polyethylene or cross-linked polyethylene. The layer 51 in direct contact with the conductor can be semiconducting to ensure a better distribution of potential. The assembly as a whole is wrapped in an armor 52 of steel wires.

I claim:

1. A submarine power cable conductor comprising:

at least one central conductor consisting of at least one layer of metal wires stranded helically at mean stranding pitch (P), insulation surrounding said stranded metal wires, and helically wound armour wires surrounding said insulation, the improvement wherein all central conductor metal wires are laid in the same direction and at a periodically varied angle a wherein the periodically varied angle generates undulation of all the central conductor wires such that all of the central conductor wires twist about a mean winding helix;

and wherein the varied angle pitch (p) of the undulation is less than twice the mean standing pitch (P);

whereby, when the central conductor is stretched, each wire in the central conductor will follow the elongation thereof through a modification of its geometrical position, bringing it closer to said means winding helix without any elongation of the wire itself, with the central conductor being of a greater length than the armour so that the armour will fulfill its carrier function and all wires of the central conductor are longer than the armour.

2. A conductor as in claim 1, wherein the peak-to-peak amplitude ($\epsilon$) of the undulation is less than 0.1 times the pitch (p) of the undulation.

* * * * *